US010335347B2

(12) United States Patent
Carrel et al.

(10) Patent No.: US 10,335,347 B2
(45) Date of Patent: Jul. 2, 2019

(54) CLOSING SYSTEM FOR A CONTAINER

(71) Applicant: Becton Dickinson France, Le Pont de Claix (FR)

(72) Inventors: Franck Carrel, Le Pont de Claix (FR); Lionel Maritan, Pierre-Chatel (FR); Frederic Perot, Saint Paul de Varces (FR); Maxime Vaupres, Caen (FR); Jean-Yves Corbin, Le Fresne Camilly (FR)

(73) Assignee: Becton Dickinson France, Le Pont de Claix (FR)

( * ) Notice: Subject to any disclaimer, the term of this patent is extended or adjusted under 35 U.S.C. 154(b) by 391 days.

(21) Appl. No.: 14/419,070

(22) PCT Filed: Aug. 1, 2013

(86) PCT No.: PCT/EP2013/066161

§ 371 (c)(1),
(2) Date: Feb. 2, 2015

(87) PCT Pub. No.: WO2014/020100

PCT Pub. Date: Feb. 6, 2014

(65) Prior Publication Data

US 2015/0216764 A1 Aug. 6, 2015

(30) Foreign Application Priority Data

Aug. 3, 2012 (EP) ..... 12305971
Jan. 28, 2013 (EP) ..... 13305096

(51) Int. Cl.
*A61J 1/14* (2006.01)
*B65D 47/26* (2006.01)
(Continued)

(52) U.S. Cl.
CPC ..... *A61J 1/1412* (2013.01); *A61J 1/1406* (2013.01); *B65D 41/50* (2013.01); *B65D 43/18* (2013.01);
(Continued)

(58) Field of Classification Search
CPC ..... A61J 1/1412; A61J 1/1403; B65D 41/50; B65D 43/18; B65D 47/265; B65D 51/002
See application file for complete search history.

(56) References Cited

U.S. PATENT DOCUMENTS 1,998,373 A 4/1935 Love
2,039,145 A * 4/1936 Burns ..... B65D 47/265 222/545
(Continued)

FOREIGN PATENT DOCUMENTS

JP 2003116628 A 4/2003
JP 2004345692 A 12/2004
(Continued)

*Primary Examiner* — Ariana Zimbouski
(74) *Attorney, Agent, or Firm* — The Webb Law Firm

(57) ABSTRACT

The invention relates to a closing system for a container to be held with a single hand. The closing system includes a cap having a skirt and a transversal wall provided with an access port, and a cover substantially parallel to the cap and with a guiding member intended to be used by a user to manipulate the cover. A hinge allows a planar rotation of the cover regarding the cap from a first position to close the access port to a second position to access the access port.

19 Claims, 12 Drawing Sheets

(51) Int. Cl.
*B65D 51/00* (2006.01)
*B65D 41/50* (2006.01)
*B65D 43/18* (2006.01)

(52) U.S. Cl.
CPC ..... *B65D 47/265* (2013.01); *B65D 51/002* (2013.01)

(56) References Cited

U.S. PATENT DOCUMENTS

| | | | | | |
|---|---|---|---|---|---|
| 2,488,120 | A | * | 11/1949 | Ferriday, Jr. ..... | B65D 47/263 215/12.1 |
| 3,352,445 | A | * | 11/1967 | Cochin ..... | B65D 47/088 220/291 |
| 4,412,625 | A | | 11/1983 | Zander | |
| 4,676,788 | A | | 6/1987 | Vincent | |
| 5,405,031 | A | | 4/1995 | Derksen | |
| 5,931,828 | A | | 8/1999 | Durkee | |
| 2004/0232160 | A1 | | 11/2004 | Kageyama et al. | |
| 2008/0053997 | A1 | * | 3/2008 | Perra ..... | B65D 47/265 220/254.3 |
| 2008/0245796 | A1 | | 10/2008 | Gnepper | |
| 2010/0133275 | A1 | * | 6/2010 | Phillips ..... | B65D 7/40 220/270 |

FOREIGN PATENT DOCUMENTS

| | | | |
|---|---|---|---|
| JP | 3153083 | U | 7/2009 |
| WO | 9809579 | A1 | 3/1998 |

* cited by examiner

CLOSING SYSTEM FOR A CONTAINER

CROSS-REFERENCE TO RELATED APPLICATIONS

This application is the United States national phase of International Application No. PCT/EP2013/066161 filed Aug. 1, 2013, and claims priority to European Patent Application Nos. 12305971.9 and 13305096.3 filed Aug. 3, 2012 and Jan. 28, 2013, respectively, the disclosures of which are hereby incorporated in their entirety by reference.

BACKGROUND OF THE INVENTION

Field of the Invention

The present invention relates to a closing system for a hand-held medical container, said closing system allowing both opening and closing of said container with a single hand.

Description of Related Art

Small containers that can be held with a single hand, such as bottles, vials or tubes are widely used in everyday life to store some material in the form of a liquid, a paste or divided matter. They usually consist in a storage compartment, intended to store the material, and a closing system, intended to prevent spilling of the material when the container is transported or turned over.

In this application, the distal end of a component or apparatus must be understood as meaning the end furthest from the hand of the user and the proximal end must be understood as meaning the end closest to the hand of the user, with reference to the injection device intended to be used with said component or apparatus. As such, in this application, the distal direction must be understood as the direction of injection with reference to the injection device, and the proximal direction is the opposite direction, i.e. the direction of the transfer of the product from the container used with the closing system of the invention, such as a vial, to the injection device.

In the medical field, hand-held containers such as vials are commonly used to store and distribute drugs or vaccines intended to be injected to patients. Such containers are inexpensive, durable and can be made sterile before being filled with a pharmaceutical product. A number of doses can be stored in a limited space and such medical containers are therefore convenient for medical staff working outside of the hospital. Indeed, they are widely used in large scale immunization programs or during pandemics, where populations living in remote area, far away from towns and hospital facilities, need to be vaccinated or cured.

These vials are usually closed by a septum intended to be pierced by the needle of an injection device. This septum therefore acts as a barrier between the inside of the vial and the outside environment: it protects the pharmaceutical product stored in said vial from outside contaminants such as dust, bacteria, germs or viruses.

However, some contaminants might reach the inside of the vial despite the septum, thus damaging the efficacy and the sterility of the pharmaceutical product. This happens especially during remote healthcare operation, where pharmaceutical products such as drugs or vaccines need to be injected to populations living far away from hospital facilities in poor hygienic conditions.

First of all, the septum itself may be damaged during transportation or when handled in rough conditions. This could include shocks, excessive sunlight, excessive temperature, very low or high humidity level, or contact with hazardous liquid. Additionally, it is sometimes difficult to guaranty favorable hygienic conditions in such remote locations, and the septum and/or the vials could be contacted by unclean hands or contaminated surfaces. Finally, and in the case of multidose vials, the septum needs to be pierced several successive times i.e. as many times as the number of product doses stored into the vial. This repeated piercing could mechanically damage the septum, for example by leaving tiny holes through its material.

There is therefore a need for a device that would protect the septum of a container, such as a vial, when it is exposed to potential contamination.

Moreover, during remote healthcare programs, a wide number of healthcare workers are usually involved and it would be difficult to provide them with specific trainings to use non obvious new devices. This is the reason why any device designed for improving the practice of healthcare workers needs to be straightforward and obvious to operate. In addition, the healthcare workers who perform injections of pharmaceutical products to patients have to carry an injection system, a case, or other medical devices, at the same time they handle the vial. Consequently, such a device should be safe and convenient to manipulate.

Therefore, it would be highly desirable to provide a device capable of protecting the septum of a container, such as a vial, while being safe, straightforward and convenient to manipulate. In particular, it would be desirable to provide a device that could be manipulated so as to give access to the opening of a container, for example the septum of a vial, or on the contrary so as to protect said opening or septum, with only one hand.

SUMMARY OF THE INVENTION

A first embodiment of the present invention is a closing system for a container to be held with a single hand, said closing system comprising:

- a cap comprising a skirt and a transversal wall provided with an access port,
- a cover substantially parallel to said cap and comprising a guiding member intended to be used by a user to manipulate said cover,
- a hinge allowing a planar rotation of the cover regarding the cap from a first position closing said access port to a second position giving access to the access port.

In one configuration, a closure for a container includes a cap comprising a skirt and a transverse wall having an access port defined therein. The closure also includes a cover extending substantially parallel to the cap and comprising a guiding member extending therefrom. The closure further includes a hinge member in communication with at least a portion of the cap and at least a portion of the cover, the hinge member allowing a planar rotation of the cover with respect to the cap from a first position in which the cover is disposed over the access port, to a second position in which the cover is spaced apart from the access port. In certain embodiments, the cover may be disposed in the same plane in both the first and second positions.

In a further configuration, a closure for a container includes a cap having an access port defined therein. The closure also includes a cover pivotally connected to the cap, wherein the cover is rotatable with respect to a portion of the cap from a first position in which a portion of the cover restricts access to the access port to a second position in which the access port is unobstructed by the cover.

In yet a further configuration, a closure for a container includes a first portion having an access port defined therein and a second portion pivotally connected to the first portion. The second portion is transitionable from a first position in which the first portion covers the access port to a second position in which the first portion is spaced apart from the access port.

The closing system of the present invention may be intended to be adapted to a hand-held container, in which case the closing system of the invention is referred to in the description of the figures below as an adaptor as it is intended to be mounted on an independent container. For example, the closing system of the invention consisting in an adaptor may be mounted on a container with the access port of the closing system of the invention facing an opening of the container, for example facing the septum of a vial. For example, the cap of the closing system of the invention as an adaptor may be mounted onto an opening of the container with the access port facing said opening. The hand-held container may be a medical container, such as for example a conventional vial for storing pharmaceutical products, such as multidose vials for vaccines. Such a vial 1 is shown on FIGS. 1A-1C and generally comprises a tubular barrel 2 having a longitudinal axis A, closed at an end and having a collar 3 at the opposite end, said collar 3 forming an opening 3*a* closed by a septum 4. Usually, the septum 4 is fixedly attached to the collar 3 of the vial 1 by a peripheral band 5, said peripheral band 5 leaving a part of the septum 4, herein called outer surface 4*a* of the septum, directly facing the outside of the vial 1, namely the outside environment. The septum 4 is usually made of a material impermeable to gas and liquid and it seals hermetically the content of the vial 1. The septum 4 is also pierceable by the needle of an injection device intended to be filled with the product contained in the vial, said septum 4 being accessible to said needle via its outer surface 4*a*.

Alternatively, the closing system of the present invention may be integrated in the hand-held container, namely may be a part of the container itself, the cap being a part of the container wall for example, with the access port facing an opening of the container.

The closing system of the present invention allows an efficient closure of the container, for example a vial, and an efficient protection of the vial septum. Thanks to the hinge and the guiding member, it is also very simple to manipulate with a single hand: the container can be grasped by one hand and only the thumb is required to open and close the cover. In particular, thanks to the guiding member and the hinge, the user can rotate the cover from its first position, also referred to hereinafter as the "closed" position of the cover, in which the cover closes the access port, to its second position, also referred to hereinafter as the "open" position of the cover, in which the cover no more closes the access port, with only one hand, and in particular with one finger, for example the thumb. The closing system is thus particularly valuable in the field of medicine where the healthcare workers often need their second hand to handle a swab, another container or an injection device. Furthermore, the cover preferably cannot be separated from the cap even if the container falls during operation. The closing system is therefore resistant to rough conditions often met in remote areas, outside the hospital.

In embodiments, the hinge of the closing system comprises a shaft extending in the distal direction from the cover, and a corner hole provided in the transversal wall. The transversal wall, the cap and the cover, may show a perimeter having the global shape of half a circle terminated by half the square inscribing said circle. For sake of clarity, it is then considered hereinafter that the transversal wall, the cap and the cover may show a global circular shape except for one linear side, namely the side of the square mentioned above, and two corners, located at each end of said linear side. For sake of clarity, in the following description, it will be considered that the transversal wall, the cap and the cover have four sides, globally corresponding to the four sides of the virtual square above, namely a linear side as defined above, an arched side, opposite said linear side, and two sides joining said linear side to said arched side. The corner hole is therefore provided at one of the corners of the transversal wall, and the shaft is intended to be received inside the corner hole. In embodiments therefore, the hinge is provided at a corner of the transversal wall. This hinge allows a straightforward planar movement of the cover regarding the cap: the cover slides in a planar rotation regarding the transversal wall to give access to the access port. Moreover, the cover can be guided during the whole movement by a single finger contacting the guiding member.

In embodiments, the guiding member is a stud. This shape has been found preferable to allow the user's thumb to guide the cover during the closing and the opening. Moreover, the stud also provides a visual and tactile indication to the user for an obvious operation of the closing system. Any health care worker is thus able to use the closing system in an appropriate way without a specific training. In other embodiments, the guiding member could be a hole, a lug or a ring. For example, the stud extends in the proximal direction from the cover.

In embodiments, the cover further comprises a pushing surface, to allow the opening of the cover by a suggested thrust movement from the user's thumb. The pushing surface also provides further visual and tactile indication for an untrained user to operate the closing system in an appropriate way.

In embodiments, the hinge is located on a side of the cover. This position allows a fast opening with only a limited movement of the user's thumb. Preferably, the hinge is also located on a rear portion of the cover, to allow a natural sliding movement to the back of the closing system.

In the present description, the terms "front" and "rear" are defined with respect to the position of the user with respect to the closing system of the invention when the user uses said closing system, with the side, part or portion of the closing system or of an element thereof closest to the user being referred to as the "front" side, part or portion of said element or closing system, and the side, part or portion of the closing system or of an element thereof furthest to the user being referred to as the "rear" side, part or portion of said element or closing system. In embodiments, the rear side of the transversal wall, cap and cover corresponds to the linear side of said transversal wall, cap and cover as defined above.

In embodiments, the pushing surface is located on a front portion of the cover, in order to be located nearby the user's thumb when the user grasps the container with his hand. Due to its position, the user is led to push onto this surface without a specific training.

In embodiments, the hinge is located at a corner of the transversal wall, and the pushing surface is located on the cover at a position diametrically opposed to said corner.

In embodiments, the stud is located on a rear portion of the cover. This position is advantageous to supplement the pushing surface during the opening movement, in particular in case the user does not grasp the container in the most appropriate way.

In embodiments, the stud is located on a first side of the cover and the hinge is located on an opposite, second side of the cover. Consequently, the stud located on a rear portion of the cover is brought nearby the user's thumb when the cover is in the open position. The closing movement is thus rendered obvious to untrained users, as they only need to pull the stud with their thumb to close the cover.

In embodiments, the pushing surface and the stud are located on the same first side of the cover. The pushing surface is thus located at another extremity of the cover regarding the hinge, which allows smooth and easy opening of the cover thanks to a leverage effect. Moreover, if the user's thumb slides from the pushing surface, for example because of water or condensation onto the cover, said thumb would come in contact with the stud and a fast opening will be possible anyway.

For example, in embodiments, the hinge is located at a corner of the rear side of the transversal wall, the pushing surface is located on the front side of the cover at a position diametrically opposed to said corner, and the guiding member, for example the stud, is located on the cover at the other corner of the rear side.

In embodiments, the closing system comprises unidirectional means only allowing a clockwise or a counterclockwise rotation. This forces the user to manipulate the closing system in only one direction, therefore restricting any inappropriate operation. The closing and the opening must be done in the same clockwise or counterclockwise movement, which renders the closing system safe and obvious to manipulate.

In embodiments, said unidirectional means comprises a tooth located on a flexible leg substantially parallel to said cover, and three openings located on said transversal wall. In particular, the flexible leg and the three openings are capable of cooperating together so as to allow only one of the clockwise and counterclockwise rotations for the cover. For example, the flexible leg is capable of successively engaging and disengaging said openings when the cover is rotated in the allowed rotation, whereas said flexible leg is definitely stuck inside one of said openings if the cover is rotated in the non authorized rotation. These unidirectional means have proven to be very reliable and easy to manufacture.

In embodiments, the closing system further comprises locking means to maintain the cover in a closed position during storage. These locking means prevent undesired opening of the cover, in particular during storage and shipping.

In embodiments, the locking means comprises a peg located on a longitudinal extension of said cover, and a notch located on the skirt. Only a small pressure is required to disengage the peg from the notch and these locking means efficiently prevents undesired opening without hampering a simple opening of the closing system.

In embodiments, said transversal wall comprises a rear extension intended to block the user's index finger, in particular in the proximal direction, when said user grasps said closing system. For example, the rear extension extends in the rear direction beyond a longitudinal wall of the skirt. This helps the user to firmly grasp the container, even if the user's hand or the container is wet or dirty. Moreover, it also helps to correctly place the thumb nearby the pushing surface and thus improves the obviousness to manipulate the closing system.

In embodiments, the closing system further comprises protection means for preventing contact, when the cover is in its second position, between the user's hand and the part of the cover intended to face the access port in the first position of the cover. For example, the part of the cover which is intended to face the access port in the first position of the cover may face the ambient environment when the cover is in its second, open, position. In such a case, the protection means prevent contact between potential unclean hands of the user and said part of the cover. When the container the closing system is a part of or is mounted onto is a container for storing a pharmaceutical product, the protection means help preventing contaminants from reaching the inside of the container and from damaging the efficacy and the sterility of the stored pharmaceutical product.

For example, the protection means may include a protruding ridge located on a distal face of the cover, offset from said part of the cover intended to face the access port in the first position of the cover, said protruding ridge defining a distal extension of said cover. The distal extension therefore keeps away the user's hand from said part of the cover in the second position of the cover. Potential contaminants of unclean hands for example are therefore kept away from the part of the cover intended to face and/or contact the access port.

In embodiments, the protection means further include a step designed on said transversal wall of said cap, said step separating said transversal wall into a proximal portion where the access port is located, and a distal lodging, offset from said access port, said distal lodging being shaped and dimensioned so as to be capable of receiving said distal extension of said cover when said cover is in its first position. In the case of inappropriate operation of the closing system, for example with unclean hands, the potentially contaminated portion of the cover, namely the distal extension formed by the protruding ridge, is therefore kept away from the access port when the cover is back in its first, closed position. Indeed, when the cover closes, the distal extension is received in the distal lodging and is separated by the step from the proximal portion of the transversal wall where the access port is located. Potential contaminants of the distal extension are therefore restricted to the distal lodging of the transversal wall and the access port remains uncontaminated.

BRIEF DESCRIPTION OF THE DRAWINGS

The present invention will now be described in greater detail based on the following description and the appended drawings, in which.

DETAILED DESCRIPTION OF THE INVENTION

Figure 1A:
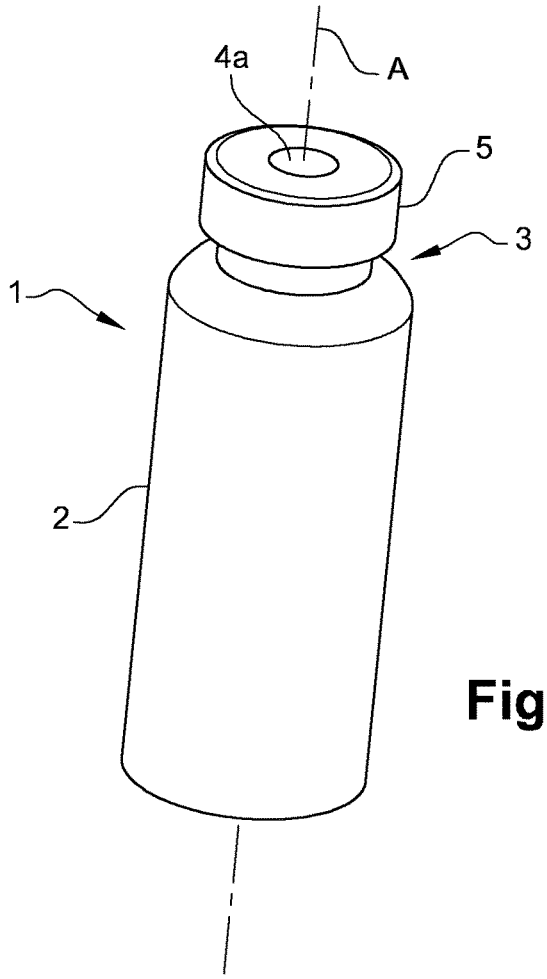
FIGS. 1A-1C are respectively a perspective view, a partial side view and a partial cross section view of a conventional vial on which the closing system, namely the adaptor, of the invention is intended to be mounted.

For purposes of the description hereinafter, the terms "upper", "lower", "right", "left", "vertical", "horizontal", "top", "bottom", "lateral", "longitudinal", and derivatives thereof shall relate to the invention as it is oriented in the drawing figures.

Figure 12A:
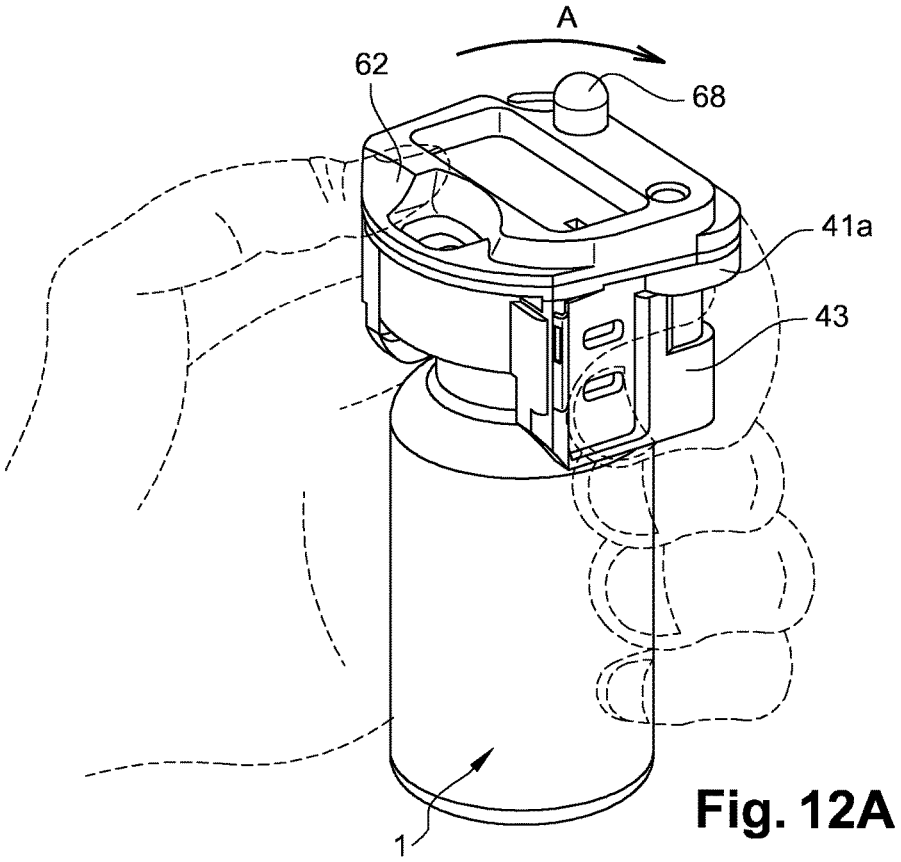
FIG. 12A is a perspective view of the adaptor of FIG. 2 coupled with a vial when opened by a user.
Figure 12C:
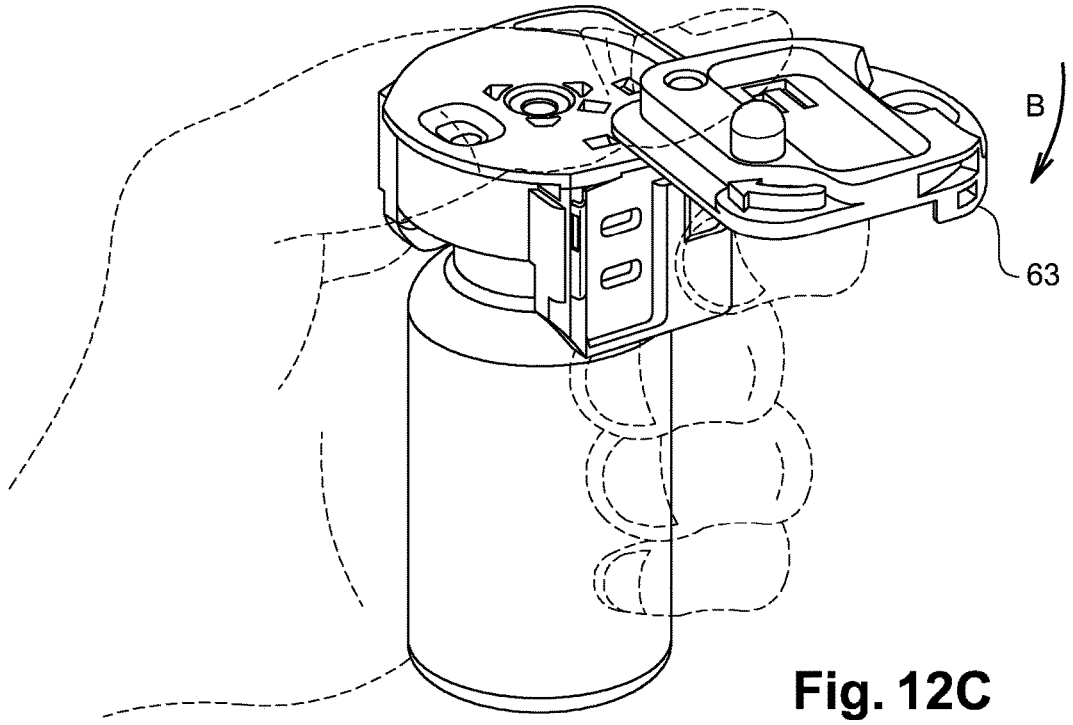
FIG. 12C is a perspective view of the adaptor of FIG. 2 coupled with a vial when closed by a user.

As seen above, and with reference to FIGS. 12A and 12C, the terms "front" and "rear" are defined with respect to the position of the user with respect to the closing system/adaptor of the invention when the user uses said closing system, with the side, part or portion of the closing system or of an element thereof closest to the user being referred to as the "front" side, part or portion of said element or closing system and the side, part or portion of the closing system or of an element thereof furthest to the user being referred to as the "rear" side, part or portion of said element or closing system.

Figure 1B:
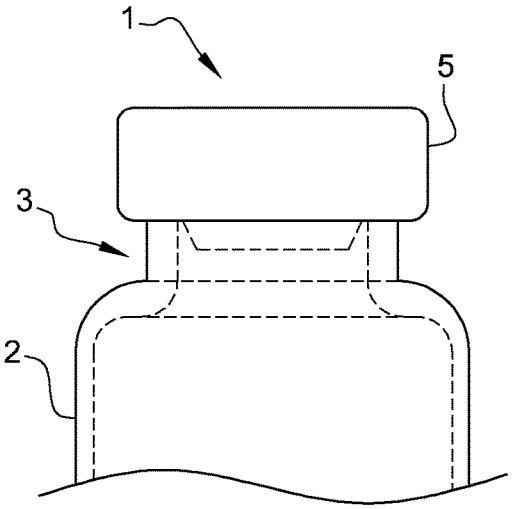
Figure 1C:
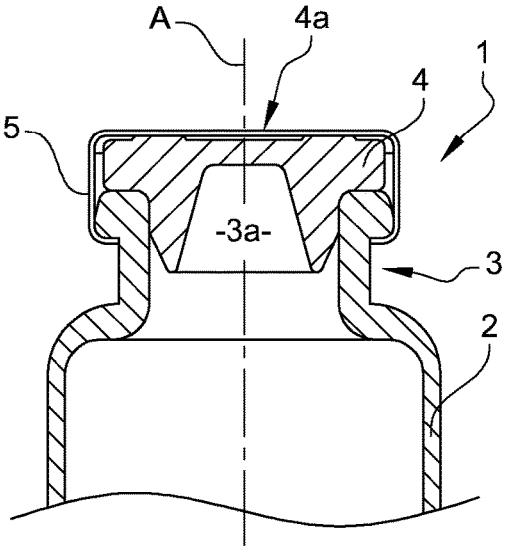
Figure 2:
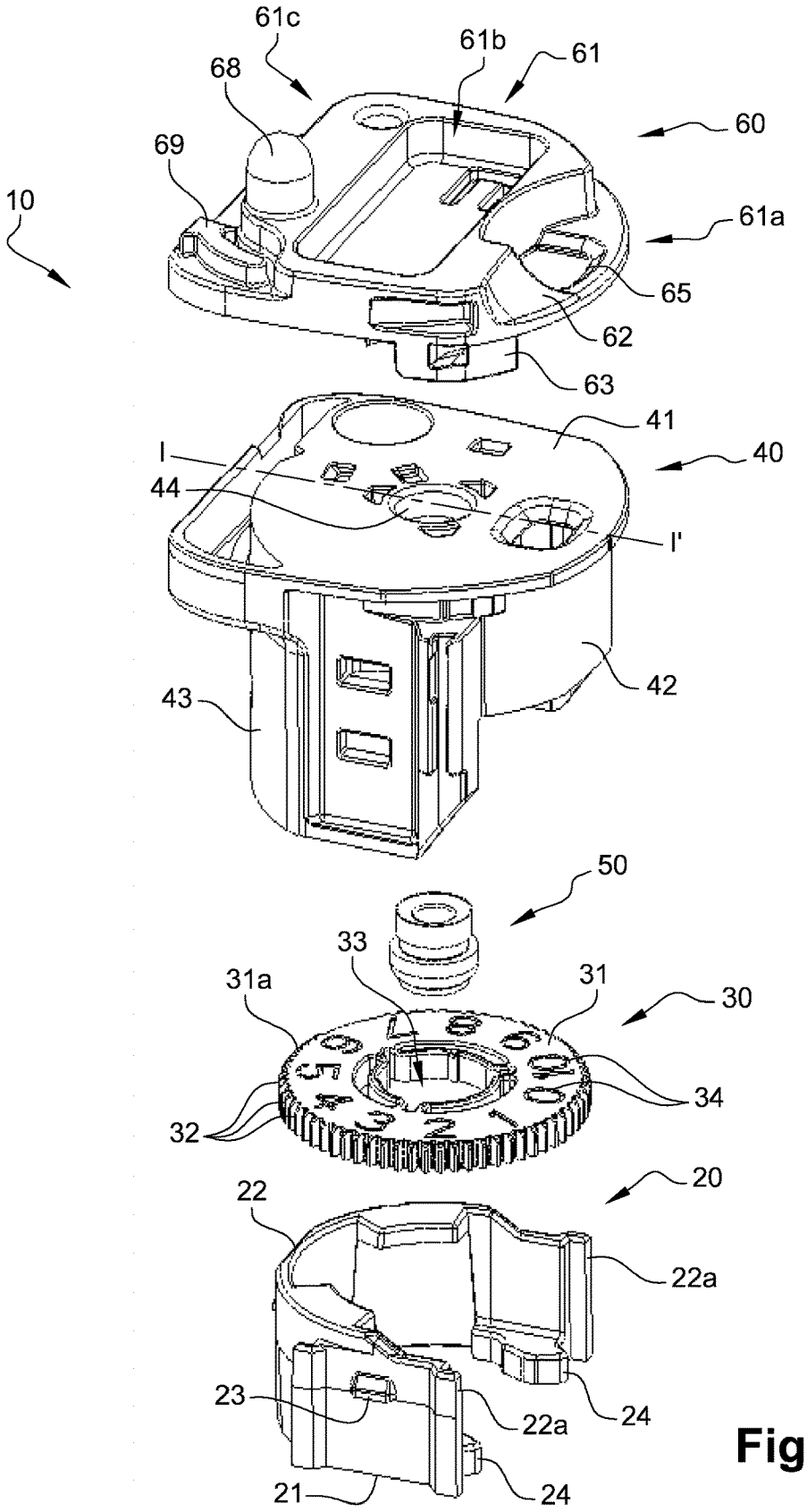
FIG. 2 is an exploded perspective view of an embodiment of the adaptor of the invention.

With reference to FIG. 2 is shown a closing system, namely an adaptor 10 in accordance with an embodiment of the invention, intended to be coupled on a multidose vial 1 as shown on FIGS. 1A-1C. The adaptor 10 of FIG. 2 comprises a gripping member 20 intended to secure the adaptor onto the vial 1, a counting ring 30 intended to provide information on the number of doses of product already withdrawn from the vial 1 and/or still left inside the vial 1, a cap 40, intended to be snap-fitted to the gripping member 20, a pierceable elastomeric piece 50 intended to be accommodated in the cap 40, and a cover 60 intended to prevent or allow access to the opening 3*a* of the vial 1, once the adaptor 10 is coupled to the vial 1.

In embodiments not shown, the closing system of the invention does not comprise any gripping member. For example in embodiments where the closing system is a part of the container itself, no gripping member is necessary. Alternatively, the cap itself may show a shape adapted for coupling and/or mounting the closing system/adaptor of the invention on the container or vial, in which case no specific gripping member is necessary.

In embodiments not shown, the closing system of the invention neither comprises a counting ring nor a pierceable elastomeric piece. The counting ring and the pierceable elastomeric piece are optional elements of the closing system of the invention.

With reference to FIG. 2, the gripping member 20 will now be described in detail. The gripping member 20 comprises a U-shaped body 21, having a partially tubular wall 22 with a height suitable for surrounding the collar 3 of the vial 1 (see FIGS. 11A-11B). The gripping member further comprises two free ends 22*a* corresponding to the ends of the branches of the U, the U-shaped body 21 therefore forming a clipping member. Close to each free end 22*a*, the tubular wall 22 is provided on its outer surface with radial pegs 23 (only one being visible on FIG. 2). Each free end 22*a* is further provided with a distal front projection forming a radial rim 24.

Still with reference to FIG. 2, the counting ring 30 is made of a flat cylinder 31 provided with a plurality of outer radial teeth 32 distributed along its periphery 31*a*. The flat cylinder 31 is further provided with a central hole 33 dimensioned and shaped so as to fit around radial outer pegs 47 of the cap 40, as shown on FIGS. 4-6. In the example shown on FIGS. 2 to 10, the adaptor 10 is intended to be coupled to a multidose vial 1 filled with ten doses of product. As a consequence, the counting ring 30 is provided with information data corresponding to these ten doses of product to be withdrawn from the vial 1. The flat cylinder 31 is thus provided with printed digits 34 indicating the numbers 1 to 10, these digits being regularly distributed along the circumference of the flat cylinder 31.

Figure 3:
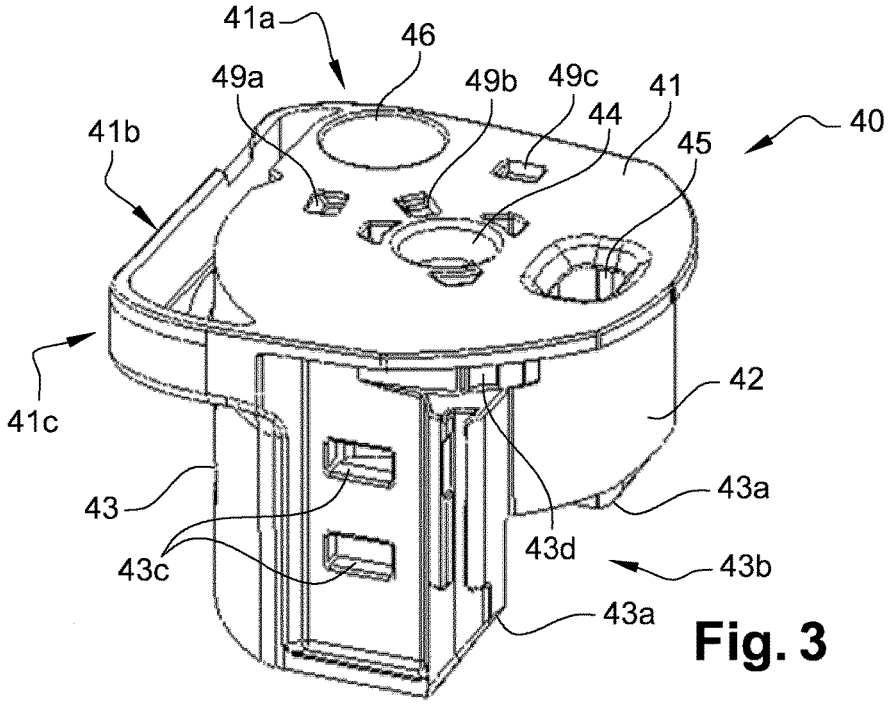
FIG. 3 is a perspective view from the top of the cap of the adaptor of FIG. 2.
Figure 4:
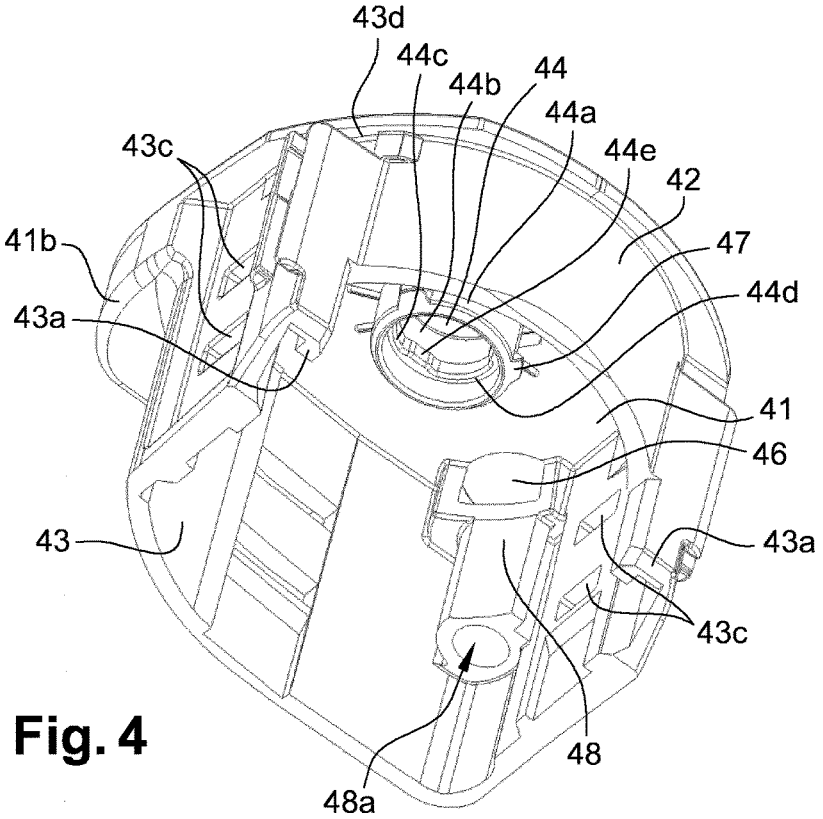
FIG. 4 is a perspective view from the bottom of the cap of the adaptor of FIG. 2.

With reference to FIGS. 3 and 4, the cap 40 will now be described in detail. The cap 40 comprises a transversal wall 41 having a substantially circular shape except a corner 41*a*, and a rear extension 41*b* defining a linear side of the cap 40, this linear side further defining a second corner 41*c* of the cap 40. A front rim 42 is extending from the front of the transversal wall 41 in the distal direction. A U-shaped skirt 43 also extends from the transversal wall 41 in the distal direction, the free ends 43*a* of the U forming a front opening 43*b* of the skirt 43. Close to each free end 43*a*, the skirt 43 is provided on its outer surface with four recesses 43*c* (only two being visible on FIG. 2) and a notch 43*d* immediately nearby the transversal wall 41. The circular transversal wall 41 is provided with a central access port 44 and with a front side hole 45. The transversal wall 41 is further provided in its corner 41*a* with a corner hole 46 surrounded by three openings 49*a*, 49*b* and 49*c* regularly placed around the corner hole. In the present embodiment, the access port 44 is designed to accommodate a needle and is described as a needle access port 44.

In embodiments not shown, the skirt of the cap as defined above may be capable of coupling and/or mounting the closing system/adaptor onto a container.

Figure 5:
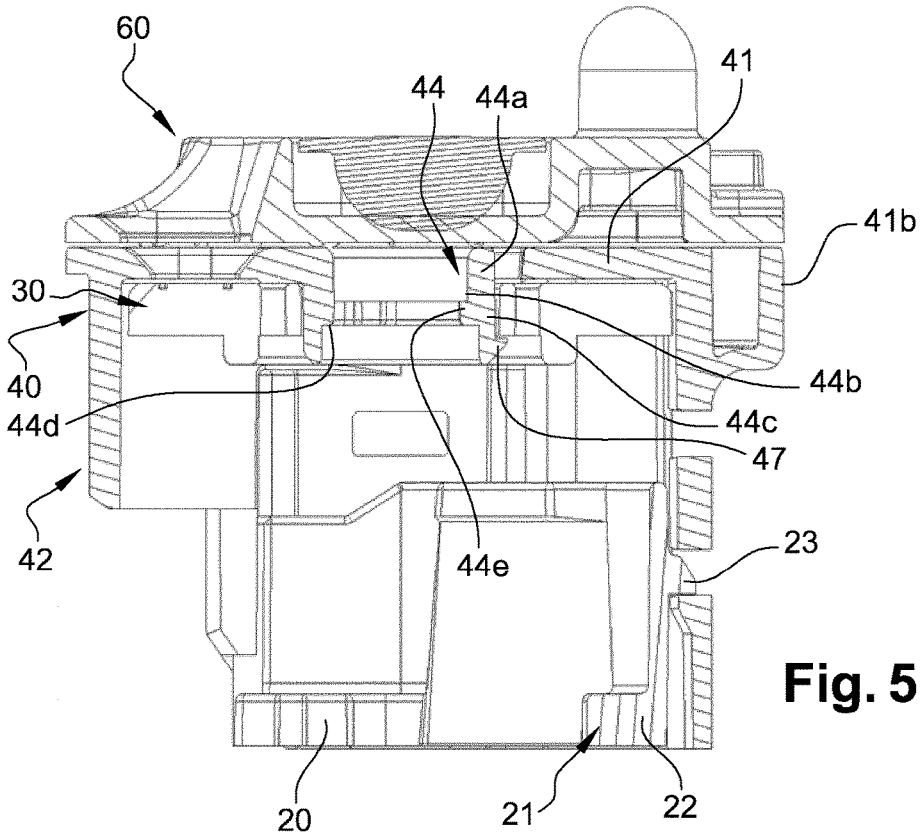
FIG. 5 is a cross-section view of the adaptor of FIG. 2, without a pierceable elastomeric piece.
Figure 6:
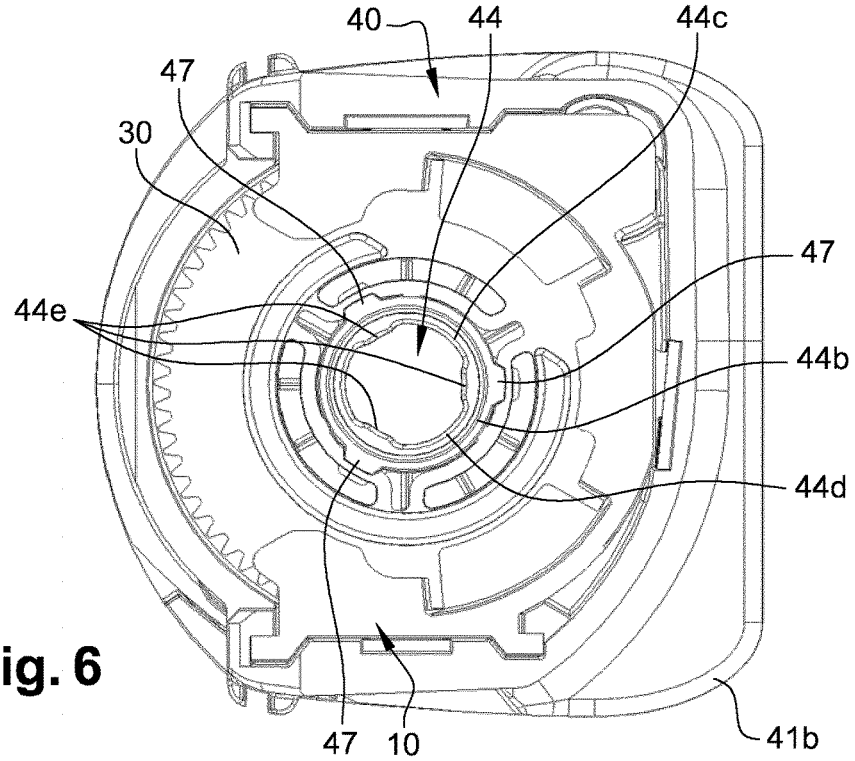
FIG. 6 is a bottom view of the adaptor of FIG. 2, without a pierceable elastomeric piece.

With reference to FIGS. 4 to 6, the proximal face of the transversal wall 41 is provided with three radial outer pegs 47 and the U-shaped skirt 43 is provided on its inner wall with a corner transversal rim 48 having a central hole 48*a* that faces the corner hole 46. The cap 40 is sized and shaped for receiving the counting ring 30 and the gripping member 20. As shown on FIGS. 5 and 6, the counting ring 30 is plugged inside the front rim 42 thanks to the radial outer pegs 47.

In embodiments not shown, in which the closing system/adaptor of the invention comprises no gripping member and no counting ring, the cap may show different shape and dimensions, as long as said cap is capable of being coupled and/or mounted onto a container, preferably with the access port facing an opening of the container.

Moreover, the U-shaped skirt 43 of the cap 40 is aligned with the U-shaped element 21 of the gripping member 20 when the different elements of the adaptor 10 are assembled. With reference to FIGS. 4 to 6, the needle access port 44 consists in a longitudinal wall 44*a* extending from the distal face of the transversal wall 41 and having an inner surface 44*b*. The inner surface 44*b* comprises an inner ring 44*c* having a distal abutment surface 44*d* present on the whole circumference of the longitudinal wall 44*a* as shown on FIG. 6 and defining three inner radial pegs 44*e* extending into the needle access port 44.

With references to FIGS. 7A and 7B, the pierceable elastomeric piece 50 will now be described in detail. The elastomeric piece 50 has globally the shape of a cylinder with a longitudinal axis L and is intended to be accommodated inside the needle access port 44 as shown on FIG. 8. In other embodiments not shown, the elastomeric piece could have globally the shape of a cube, a pyramid or a cylinder with a non-circular base. It comprises a recess 51 opened in the proximal direction, a proximal surface 52, a distal surface 53 and an outer wall 54. The recess 51 with its proximal opening 51*a* comprises an inner longitudinal surface 51*b* and a bottom surface 51*c* provided with a central protrusion 55. The proximal surface 52 of the elastomeric piece 50 is slopped distally toward the center of the recess 50, preferably with an angle of 45° to 75° regarding the longitudinal axis L and is linked to the inner longitudinal surface 51*b* by a chamfer 52*a*: a bull nose in the present case. The distal surface 53 defines a protruding part 53*a* that is extending distally. The outer wall 54, which links the distal surface 53 with the proximal surface 52, comprises a circular groove 56 defining a proximal shoulder 57, both circular groove and shoulder extending on the whole circumference of the longitudinal wall 54 as shown on FIG. 7B. The circular groove 56 is intended to be engaged with the inner radial pegs 44*e* of the needle access port 44 and the shoulder 57 is intended to contact the abutment surface 44*d* of the needle access port 44 when the pierceable elastomeric piece 50 is assembled in the cap 40 as it can be seen on FIG. 8.

Figure 7A:
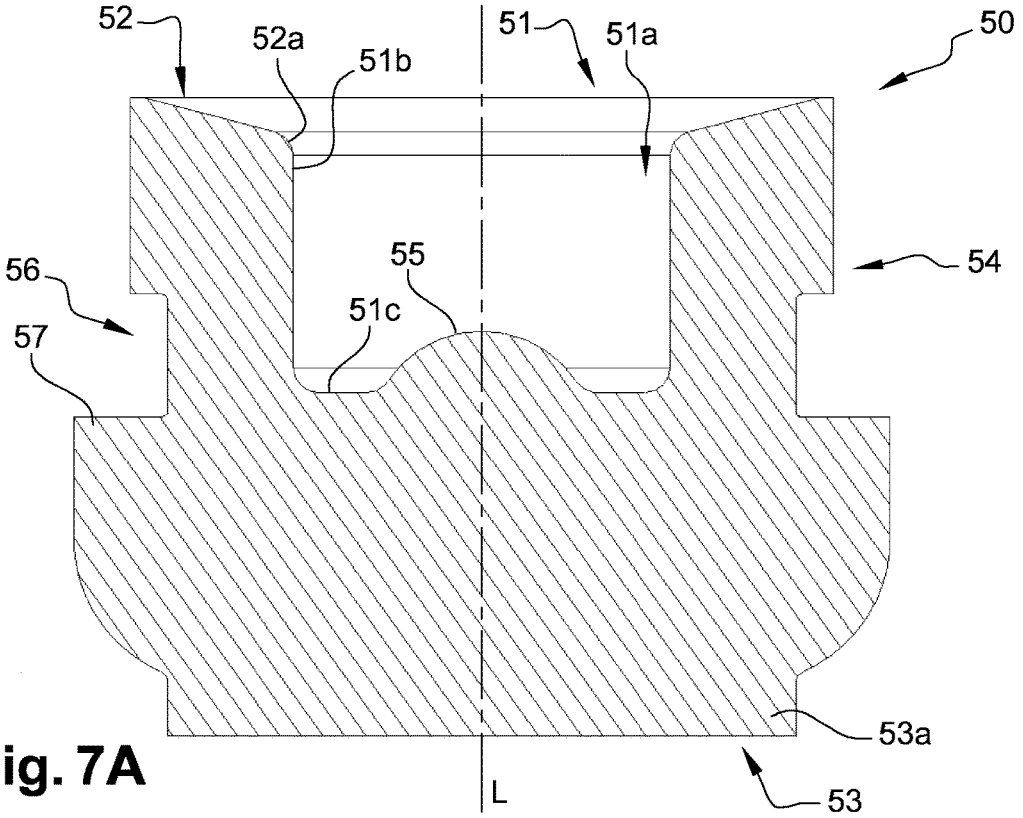
FIGS. 7A and 7B are respectively a cross-section view and a top perspective view from the top of the elastomeric piece of the adaptor of FIG. 2.
Figure 7B:
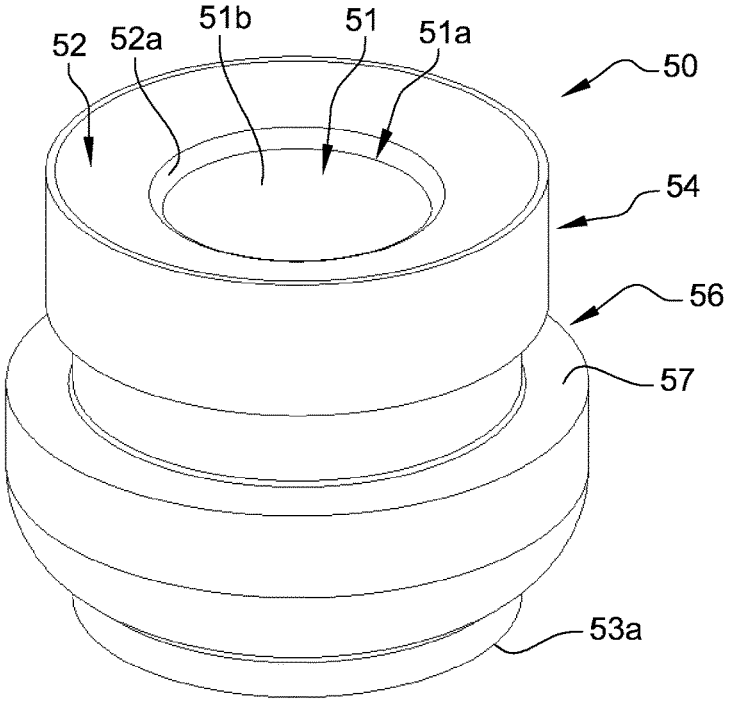
Figure 8:
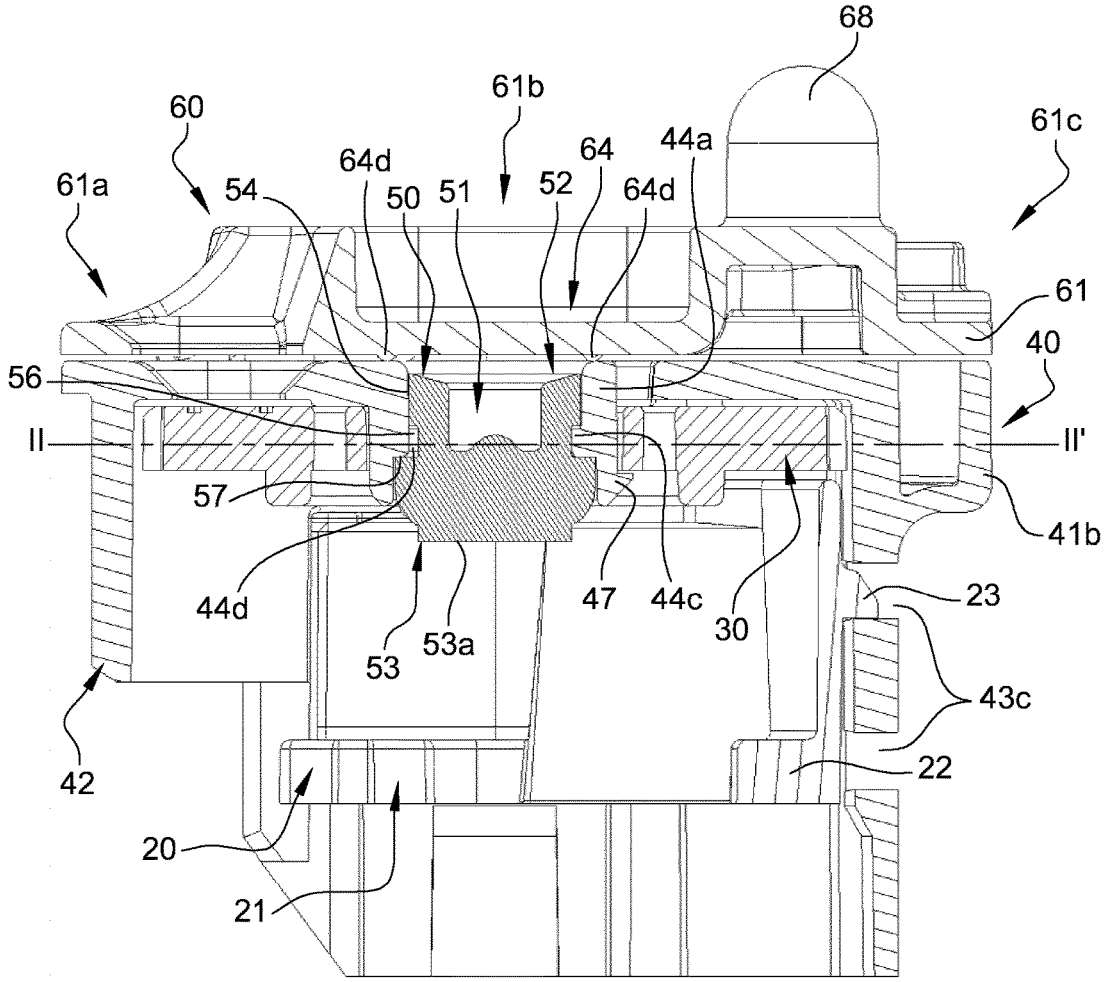
FIG. 8 is a cross-section view of the adaptor of FIG. 2, with a pierceable elastomeric piece.

In the embodiment shown on FIGS. 7-8, the ratio between the height of the central protrusion 55 of pierceable elastomeric piece 50 regarding the height of the recess 51 is about 0.2 while the ratio between the width of the central protrusion 55 regarding the width of said recess 51 is about 0.6. In the embodiment shown on FIGS. 7A and 7B, the recess 51 has a diameter of 3 mm and a height of 2.4 mm. The distance between the bottom surface 51*c* of the recess 51 and the distal surface 53 of the elastomeric piece is about 2.8 mm. This distance should be adapted to the length of the needle lumen that will pierce the septum in order to prevent ambiant air to be sucked inside the vial 4 when the needle is removed from the pierceable elastomeric piece 50.

As it can be seen on FIG. 8, the height of the pierceable elastomeric part is slightly higher than the height of the needle access port 44 and the protruding part 53*a* of the pierceable elastomeric piece is projected beyond the distal part of the longitudinal wall 44*a* of the needle access port 44. This allows the protruding part 53*a* to contact and deform the outer surface 4*a* of the septum 4 when the adaptor 10 is mounted onto a medical container as it is shown on FIG. 11B. In other words, the outer surface 4*a* of the septum 4 is engaged by the protrusion part 53*a*. In others embodiments not shown, the ratio of the height of the recess 51 regarding its width is comprised between 0.3 to 0.7, while the ratio between the height of the central protrusion 55 and the height of the recess is comprised between 0.1 to 0.3 and a ratio between the width of the central protrusion and the width of the recess is about 0.3 to 0.7.

Suitable materials for the pierceable elastomeric piece 50 of the adaptor of the invention include natural rubber, acrylate-butadiene rubber, cis-polybutadiene, chlroro or bromobutyl rubber, chlorinated polyethylene elastomers, polyalkylene oxide polymers, ethylene vinyl acetate, fluorosilicone rubbers, hexafluoropropylene-vinylidenefluoride-tetrafluoroethyleneterpolymers, butyl rubbers, polyisobutene, synthetic polyisoprene rubber, silicone rubbers, styrene-butadiene rubbers, tetrafluoroethylene propylene copolymers, thermoplastic-copolyesters, thermo-plastic elastomers, or the like or a combination thereof.

Preferably, the elastomeric piece is self-resealing and it automatically and rapidly closes the hole produced by the piercing of the needle, for example in less than 0.5 seconds, once the needle is removed from the elastomeric piece. This automatic closure step may occur a high number of times, in particular as many times as necessary for removing the number N doses of product initially present in the multidose vial 1. Suitable materials for self-resealing pierceable elastomeric piece include synthetic polyisoprene, natural rubber, silicone rubber, thermo-plastic elastomers, or the like or a combination thereof.

The cover 60 will now be described in detail with reference to FIGS. 2, 8, 9A and 9B. The cover 60 comprises a sheet 61 having substantially the shape of the transversal wall 41 of the cap 40, with a front portion 61*a*, a central portion 61*b*, a rear portion 61*c* and a corner 61*d* on a side of the rear portion 61*c*. The cover 60, and particularly the sheet 61, is substantially parallel to the cap 40, particularly to the transversal wall 41 of the cap 40. When the cover 60 is mounted onto the cap 40 in a closed position (FIGS. 8 and 9A), the front portion 61*a* is intended to be aligned with the front rim 42, the central portion 61*b* is intended to cover the needle access port 44 and the rear portion 61*c* is intended to cover the rear extension 41*b*. Considering the proximal face of the sheet 61 shown on FIGS. 2 and 9A, the front portion 61*a* of the cover 60 comprises a front hole 65 intended to face the front side hole 45 of the transversal wall 41 of the cap 40 as well as a pushing surface 62 located on a side of the front portion 61*a* intended to be in contact with the thumb of a user when the adaptor 10 is in a use-position, as it will be described below with reference to FIG. 12A. In the present embodiment, this pushing surface 62 is substantially curved and turned toward the proximal direction and the front portion of the cover 60. The central portion 61*b* consists in a planar portion 64 defining a space for writing data or sticking a label. On the same side than the pushing surface 62, the rear portion 61*c* of the sheet 61 is provided with a guiding member, for example a stud 68, extending proximally and an optional arrow 69 that can be present for indicating the direction of the rotation of the cover 60 when the adaptor 10 is in a use-position. In the present case, the arrow indicates the clockwise direction.

In this preferred embodiment, both the stud 68 as guiding member and the pushing surface 62 are significantly offset to the corner 61*d* where the hinge (46, 66) (see FIGS. 3 and 9B) for the rotation of the cover 60 with respect to the cap 40 is located. Preferably, the pushing surface 62 is located as far as possible from the corner 61*d*, while the guiding member, namely the stud 68, could be located slightly closer to that corner i.e. not at the extremity of the sheet 61. For example, the ratio between the distance of the corner 61*d* to the stud 68 and the distance of the corner 61*d* to the center C of the sheet 61 may range from 1.5 and 0.75.

More precisely, as the cover 60 is considered to have a substantially circular shape defining a center C located on the planar portion 64, therefore the pushing surface 62 is localized at about 180° from the corner 61*d* including the hinge (46, 66) (see FIGS. 3 and 9B), while the guiding member, namely the stud 68, is placed approximately at 270° clockwise. The front hole 65 is located approximately at 135° clockwise from the corner 61*d*, but any other convenient area of the cover 60 could be also considered.

In other embodiments not shown, the guiding member could have another form such as a hole, a lug or a ring and the distal surface bulges from the sheet 61.

Figure 9A:
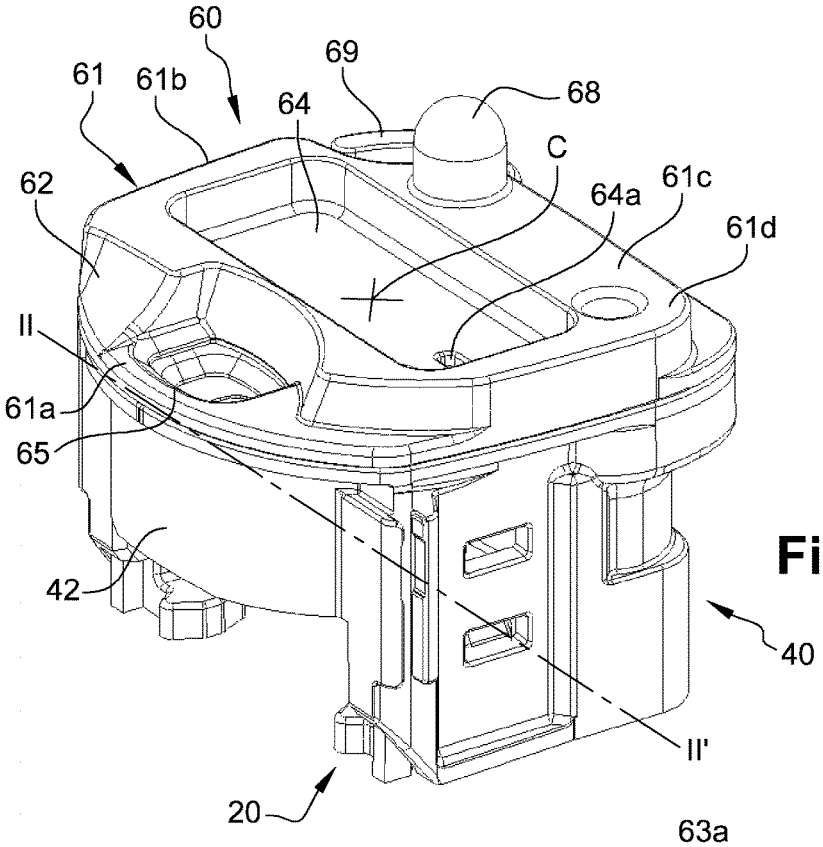
FIGS. 9A and 9B are respectively a perspective view from the top of a cover assembled on the adaptor of FIG. 2 and a perspective view from the bottom of a cover not assembled on the adaptor of FIG. 2.
Figure 9B:
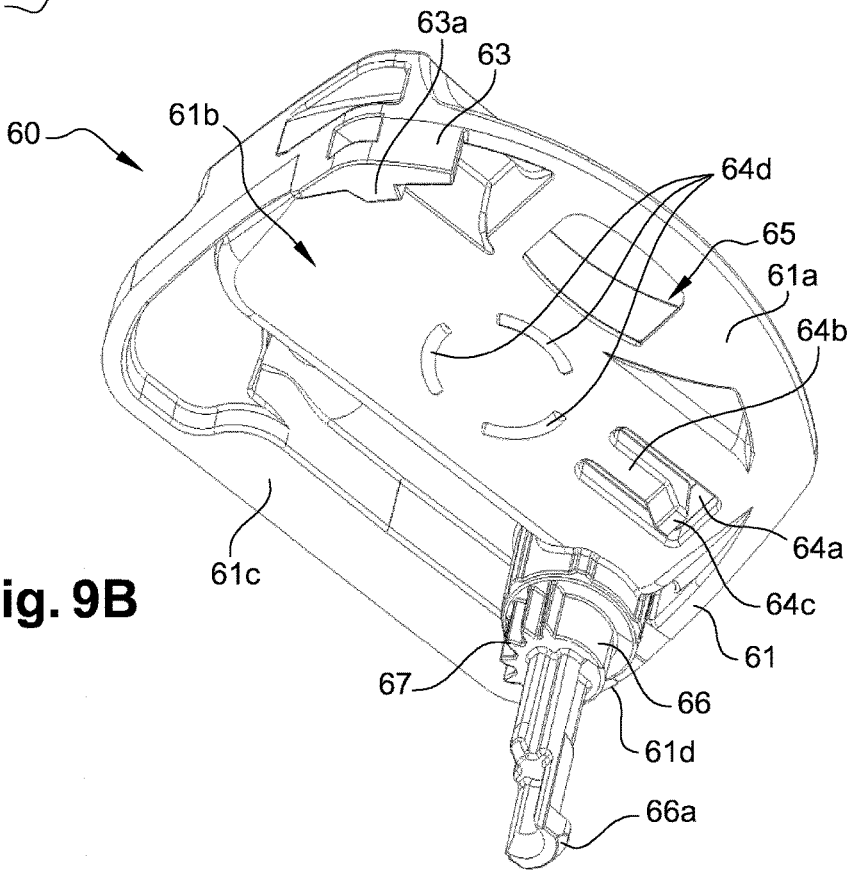
Figure 10:
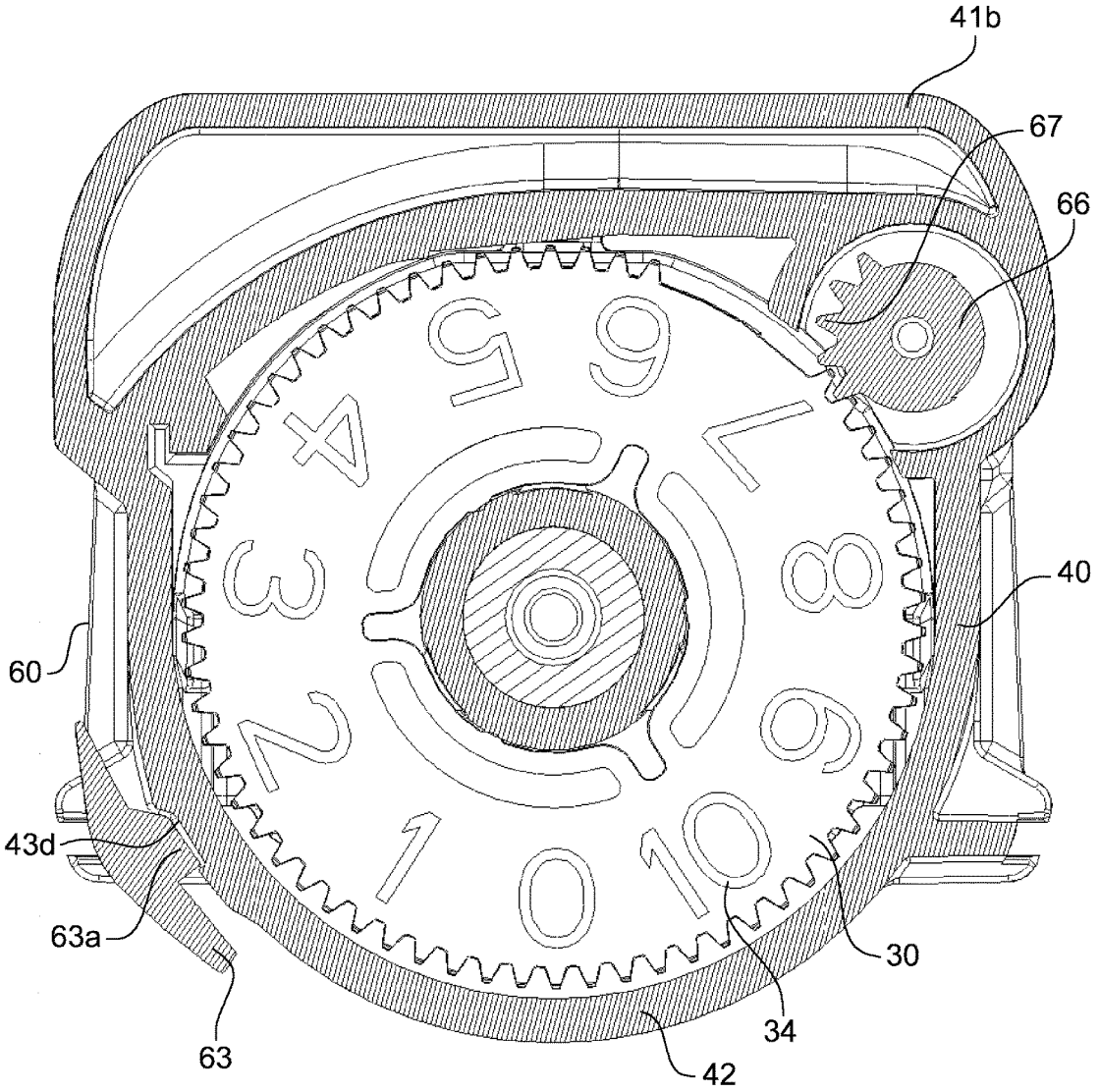
FIG. 10 is a cross-section view of an adaptor of FIG. 9A, along line II-II'

Now considering the distal face of the sheet 61 as shown on FIG. 9B, the front portion 61*a* includes a longitudinal extension 63 directed in the distal direction and provided with a radial peg 63*a* (FIGS. 2 and 9B). When the cover 60 is assembled onto the cap 40 in a closed position, the peg 63*a* of the extension 63 is engaged with the notch 43*d* of the U-shaped skirt 43, as it can be seen on FIG. 10, thereby forming locking means.

Furthermore, as shown on FIGS. 9A and 9B, the planar portion 64 is provided with a window 64*a* having a flexible leg 64*b* substantially parallel to the sheet 61 and comprising a distal tooth 64*c*. The distal tooth 64*c* comprises a straight surface and a sloped surface. When the cover 60 is assembled with the cap 40 in a closed position, the distal tooth 64*c* is capable to cooperate with the openings 49*a*, 49*b* and 49*c* as will be explained below. On the distal face of the planar portion, a discontinuous circular rim 64*d* comprising three segments is intended to face the needle access port 44 of the cap 40 as well as the proximal opening 51*a* of the pierceable elastomeric piece 50, when the cover 60 is assembled on the adaptor 10 and in a closed position. More generally the discontinuous circular rim 64*d* can comprise at least one discontinuous segment. The corner 61*d* of the sheet 61 is provided with a shaft 66 extending in the distal direction having a distal outer rim 66*a* at its extremity, as shown on FIG. 9B. Additionally, a semi-gear wheel 67 is present on the shaft 66. The semi-gear 67 is proximally spaced from the distal outer rim 66*a* and has outer radial teeth only on a part of its circumference.

The sheet 61 may be made of any material such as high-density polyethylene, polypropylene, polyvinyl chloride, acrylonitrile-butadiene-styrene (ABS), silicon resin or any other rigid polymer. Alternatively, materials such as metal, wood or glass may be used.

In the embodiment of the closing system/adaptor of the invention as described in FIGS. 2-12C, the hinge (46, 66) is therefore provided at a corner 41*a* of the rear side of the transversal wall 41, the pushing surface 62 is located on the front side of the cover 60 at a position diametrically opposed to said corner 41*a*, and the guiding member, for example the stud 68, is located on the cover 60 at the other corner of the rear side.

The use of the closing system of the invention as an adaptor 10 once connected with a vial of FIGS. 1A-1C will now be explained with reference to FIGS. 11A to 12C.

Figure 11A:
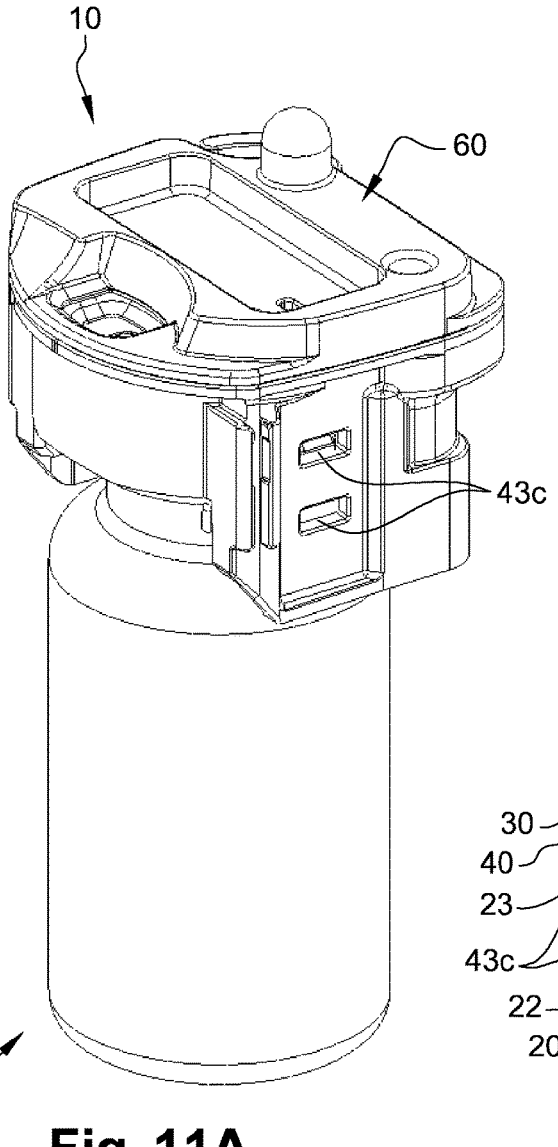
FIGS. 11A and 11B are respectively a perspective view and a cross section view of the adaptor of FIG. 2 coupled with a vial.
Figure 11B:
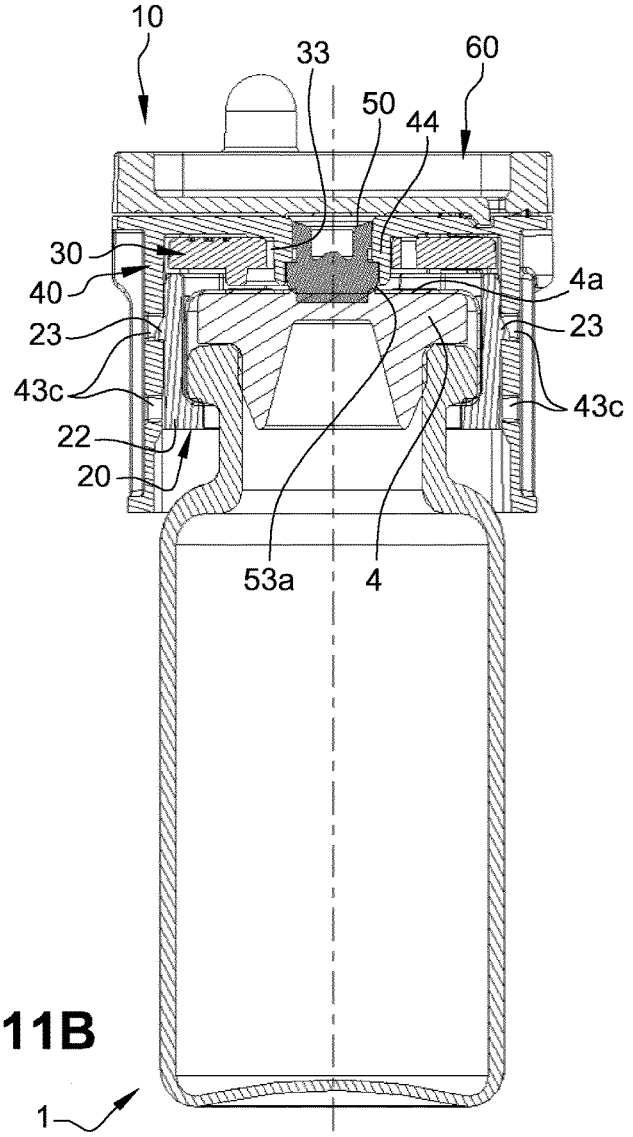

With reference to FIGS. 11A and 11B, the adaptor 10 is shown once coupled to a vial 1 and closed by the cover 60. In this view, the gripping member 20 has been mounted on the collar 3 of the vial and the radial rims 24 now surround the collar 3, thereby securing the adaptor 10 on the vial 1. In this coupled position of the adaptor 10 on the vial 1, the needle access port 44, in which is lodged the pierceable elastomeric piece 50, is aligned with the septum 4 and with the opening 3*a* of the vial 1.

The pierceable elastomeric piece 50 extends through the central hole 33 of the counting ring 30 to come in close contact with the outer surface 4*a* of the septum 4 of the vial 1. In particular, the protruding part 53*a* even distorts the outer surface 4*a* of the septum 4, as can be seen on FIG. 11B. The pierceable elastomeric piece 50 is maintained in the needle access port 44 by the engagement of the inner radial pegs 44*e* of the needle access port in its circular groove 56. Moreover, a proximal pressure is applied by the protruding part 53*a* on the outer surface 4*a* of the septum 4. Any proximal translation of the pierceable elastomeric piece 50 regarding the cap 40 is prevented as the shoulder 57 is resting on the abutment surface 44*d* of the needle access port 44. The inner radial pegs 44*e* together with the circular groove 56, and the abutment surface 44*d* together with the shoulder 57 therefore form attaching means for maintaining the elastomeric piece 50 into the needle access port 44.

The attaching means 44*c*, 56, 57 and 44*d* appropriately connect the elastomeric piece 50 and also allow a fast and straightforward assembly of the elastomeric piece 50 inside the needle access port 44. Indeed, the elastomeric piece 50 can be presented by the distal face of the cap 40, proximally pushed into the needle access port 44. It is easily deformed in the needle access port thanks to its elastomeric properties which allows the inner radial pegs 44*e* to pass along the distal portion of the longitudinal wall 54 up to the circular groove 56. The shoulder 57 rests on the abutment surface 44*d* of the needle access port 44 and prevents any further proximal translation: the elastomeric piece 50 is correctly assembled with the cap 40.

With reference to FIGS. 8, 11A and 11B, the flat cylinder 31 of the counting ring is snap-fitted on the cap 40 and the central hole 33 is engaged with the radial outer pegs 47 of the cap 40, is blocked in the distal direction. Therefore, the flat cylinder 31 is capable of rotating with respect to said radial outer pegs 47.

Additionally, the cap 40 is itself snap-fitted on the gripping member 20 thanks to the recesses 43*c* engaged with the radial pegs 23 present on the tubular wall 22 of U-shaped element 21 of the gripping member 20. As a consequence, the cap 40 is fixed with respect to the gripping member 20. In an embodiment not shown, the cap 40 and the U-shaped element 21 can be integrated together and form a single element, namely a cap acting as a gripping member.

According to the FIGS. 11A and 11B, the cover 60 is linked to the cap 40 as the shaft 66 is plugged into the corner hole 46 of the transversal wall 41 and snap-fitted into the corner transversal rim 48 as it can be seen on FIGS. 4 and 9B. The shaft 66 can rotate within corner hole 46, in a clockwise direction indicated by the arrow 69. The shaft 66 together with the corner transversal rim 48 therefore form a hinge at the corners 41*a* and 61*d* of the cap 40 and the cover 60, respectively. This hinge (46, 66) allows the planar rotation of the cover 60 from a first position closing the needle access port 44 to a second position giving access to the needle access port 44. For a straightforward and efficient rotation, this hinge is located on a side of the cover 60. More precisely, in the present embodiment, the hinge (46, 66) is located on the rear portion of the cover 60, i.e. on the corner 61*d*. The cover 60, the cap 40 and the hinge (46,66) therefore form a closing system for the vial 1.

The cover 60 is maintained in its first, closed position as the peg 43*a* engages the notch 63*d* of the cap 40, the peg 63*a* and the notch 43*d* serving as locking means for preventing any undesired rotation of the cover 60. The cover 60 therefore allows an efficient protection against dust and contamination of the elastomeric piece 50 and thus of the septum 4 of the vial 1, when the vial 1 is not in used.

Usually the vials containing vaccines are stored at cold temperature (2-8° C.) and, when a user takes a vial out of the refrigerated storage, some condensation could appear on the surface of the vial septum and/or on the surface of adaptor 10 as it is exposed to ambient temperature. The discontinuous circular rim 64*d* of the cover 60 is in tight contact with the transversal wall 41 of the cap 40, in particular with the portion located around the needle access port 44, when the cover 60 is in its closed position. This prevents any condensation from being trapped into the recess 51 while effectively closing the needle access port 44 as this discontinuous circular rim 64*d* allows a gas exchange between the recess 51 and the outside environment.

Furthermore, the distally sloped surface 52 of the elastomeric piece 50 shown on FIGS. 7A and 7B is also designed to guide the condensation towards the recess 51 therefore limiting the trapping of the condensation between the elastomeric piece 50 and the needle access port 44. The growth of bacteria around the elastomeric piece 50 is therefore widely prevented, as this space is kept dry from condensation. The condensation is not trapped but directed towards the recess 51 where it can be evaporated, even when the cover 60 is closed thanks to the discontinuous rim 64*d*.

Thanks to its configuration, the protrusion 55 of the recess 51 remains a dry and clean pierceable surface as the limited amount of condensation is restricted to a portion of the bottom surface around the protrusion 55. The discontinuous circular rim 64*d*, the distally sloped surface 52 and the protrusion 55 are thus all designed in such a way to prevent or to limit contamination due to bacteria growing in condensation nearby the pierceable elastomeric piece 50 and the septum 4.

When the user needs to withdraw a first dose of product, he grasps the adaptor 10 coupled to the vial 1, his index finger contacting the U-shaped skirt 43 and the rear extension 41*b* of the cap 40 as can be seen on FIG. 12A. The thumb is placed on the pushing surface 62 of the cover 60, while the other fingers are gripping the vial 1. To move the cover 60 from its first closed position to a second open position, the user just pushes the pushing surface 62 with his thumb in direction A, therefore disengaging the peg 63*a* of the cover 60 from the notch 43*d* of the cap 40 as shown on FIG. 10. This movement leads to a planar, clockwise rotation of the cover 60 with respect to the cap 40. During this rotation, the distal tooth 64*c* of the cover 60 successively engages with, and escapes from, the openings 49*a*, 49*b*, and 49*c* of the cap 40 as this tooth 64*c* has a sloped surface inclined toward the direction of the rotation as seen on FIG. 9B. Thanks to its straight surface in the counter direction of the rotation, the flexible leg 64*b* and the distal tooth 64*c* prevent the cover 60 from moving in the counterclockwise direction, and therefore form, together with the openings 49*a*, 49*b* and 49*c* unidirectional means authorizing only the clockwise rotation. These unidirectional means help and guide the user to operate the adaptor 10 in a safe and appropriate manner, even if he has not received any particular training.

To complete the movement of the cover 60 to its second, open position, the user sustains the pressure on the pushing surface 62 until the cover 60 is at 180° of its first position and allows the access to the needle access port 44.

Then the user can withdraw a dose of the pharmaceutical product stored in the vial 1. This can be done by turning the vial over, the proximal face of the transversal wall 41 now substantially facing the ground as shown on FIG. 12B. The user then pierces both the elastomeric piece 50 and the septum 4 of the vial 1 with the needle 71 of an injection device 70. Thanks to the proximal surface 52 of the elastomeric piece 50, sloped distally towards the center of the recess 51, the needle 71 is guided into the recess 51 to pierce directly the central protrusion 55. Thanks to the appropriate inclination of the sloped proximal surface 52, the risk of accidental pricking of the user by ripping of the needle on the needle access port is significantly reduced. When the needle 71 pierces the elastomeric piece 50 and the septum 4, it directly penetrates the dry and clean protrusion 55, and is not contaminated by any dust or bacteria developing in condensation water.

The user can then fill the injection device 70 by withdrawing a dose of the pharmaceutical product contained in the vial. Even if the inside of the vial 1 is under vacuum after removal of the needle 71, no outside air is sucked inside. Indeed the distal surface 53 of the elastomeric piece 50 and in particular the protruding part 53*a* engages the surface 4*a* of the septum 4. The interface between the elastomeric piece 50 and the septum 4 is preserved from outside air, condensation and contaminants; the elastomeric piece 50 and the septum 4 of the vial 1 behave has a single piece. The elastomeric piece 50 therefore allows the septum 4 of the vial to reseal before the complete removal of the needle 71 and prevent sucking of the outside air into the vial.

With the cover 60 in an open position, the elastomeric piece is directly exposed to outside contaminants. Nonetheless, any direct contact is avoided with the bottom surface of the elastomeric piece, intended to be pierced, even if the user's fingers or any contaminated surface might come in contact with the pierceable elastomeric piece 50. The recess 51 and the proximal surface 52 prevent the user's finger or any other contaminated surface to contact the bottom surface 53. Moreover, if any dust would penetrate the recess or if any condensation would form, they will mainly be restricted around the protrusion 55, therefore keeping the protrusion 55, intended to be pierced, substantially away from contaminants. The recess 51 therefore provides an additional and valuable protection against the contamination of the inside of the vial 1. This is particularly important when the adaptor 10 is used in locations where the user has a limited access to efficient soap or sterilizing solution.

After the injection device 70 is filled with the pharmaceutical product, the adaptor 10 can be closed. Performing this step implies moving the cover 60 from the second open position back to its first closed position. The pushing surface 62 of the cover is now in the opposite direction as regards of the thumb of the user who has to pull on the stud 68 with his thumb for moving the cover 60 in a planar clockwise movement towards its closed position. In this position, the peg 63*a* of the cover 60 is re-engaged in the notch 43*d* of the cap 40 and the cover 60 is locked.

The position of the pushing surface 62 on an opposite side from the hinge (46, 66) and preferably as far as possible, allows a leverage effect resulting in very smooth and easy movement of the cover 60 at the beginning of its rotation. The position of the guiding member, namely the stud 68, offset from the corner 61*d* but not at the extremity of the sheet 61, allows closing the cover 60 with a limited movement of the user's thumb.

The pushing surface 62 and the stud 68 therefore permit a relay as an interface for the user's thumb. The pushing surface 62 allows the user to rotate the cover 60 for the first 180° (the opening), while the stud 68 allows the user to rotate the cover 60 for the last 180° (the closing). The pushing surface can also help the user for the very last degrees of the rotation, as it is almost came back to its first position in front of the thumb. The stud 68 can also be used during the opening, for example if the user is unable to grasp the vial 1 in an appropriate way. These two interfaces, namely the pushing surface 62 and the guiding member 68 therefore allow a straightforward and reliable operation of the cover 60.

During the whole operation, only a single hand is required to open and close the cover 60 of the adaptor 10. Thanks to the hinge formed by the shaft 66 coupled with the corner hole 46 of the cap 40, together with the pushing surface 62 and the stud 68, the cover 60 can be moved with a single thumb, the other fingers grasping both the vial and the adaptor. As a result, the user can grasp with its second hand any other required material, such as an injection device.

Moreover, the clockwise rotation indicated by the arrow 69 present on the cap is forced by the unidirectional means 64*b*, 64*c*, 49*a*, 49*b* and 49*c*. Additionally, the fingers of the user are just in contact with the cover 60 and with the rear extension 41*b* of the cap 40 and contact neither the cap 40 nor the elastomeric piece 50. This leads to a safe and straightforward operation with limited contamination, as the user is prevented from touching the pierceable elastomeric piece 50. The user is therefore preserved from any accidental pricking or movement and does not require particular training to properly operate the adaptor 10.

Indeed, the closing system comprising the transversal wall 41, the cover 61 and the hinge (46, 66) could be used with any container intended to be manipulated with a single hand, particularly in the medical area but also in the fields of cosmetics, food or industry. The closing system according to the present embodiment of FIGS. 2-12C consists in an adaptor mounted on a container, but in other embodiments, the closing system of the invention could be directly integrated on the container, therefore providing a container "ready-to-use" without the mounting step.

The closing system of the present invention allows a safe and straightforward manipulation even when operated by an untrained user.

Figure 12B:
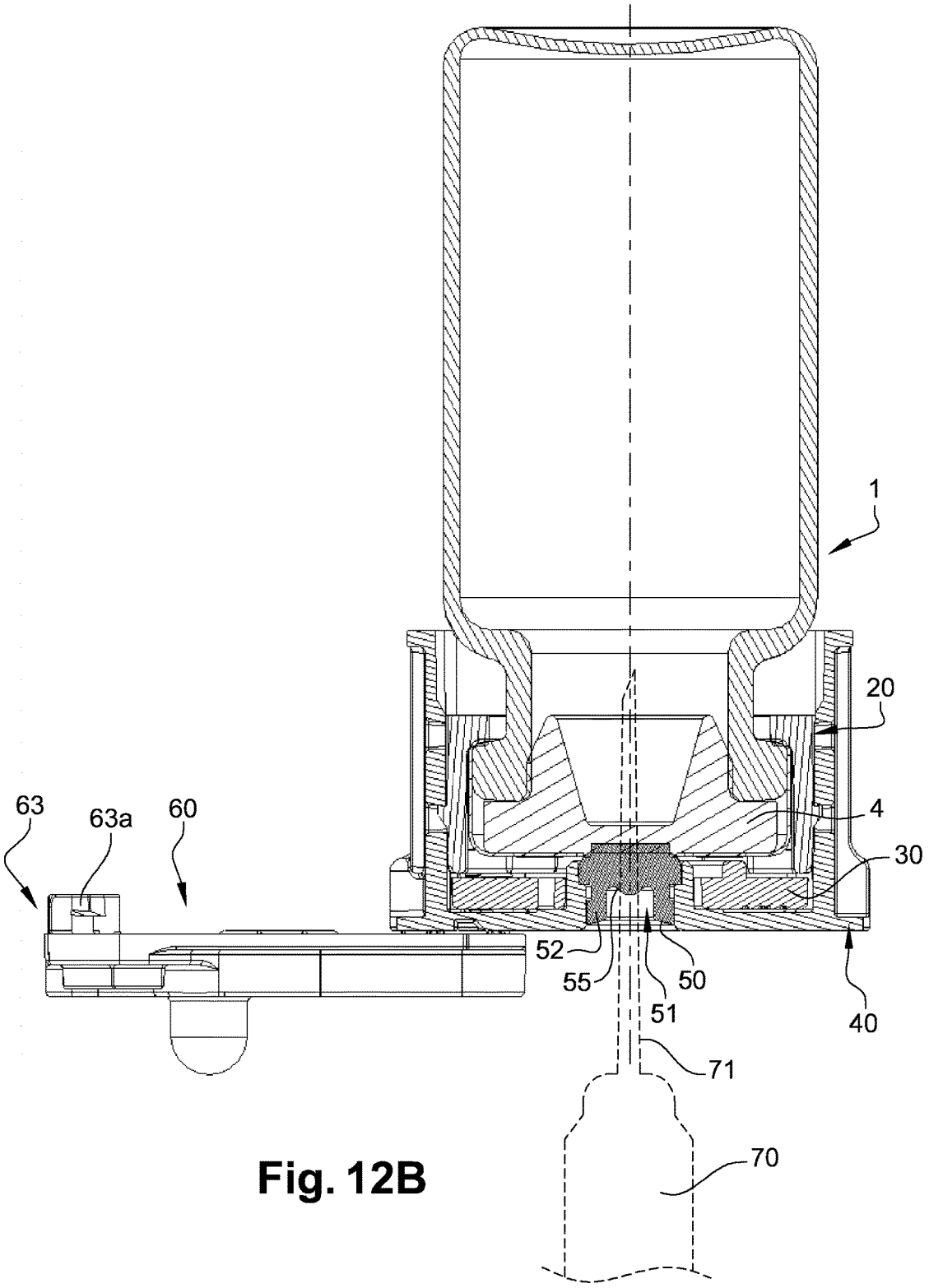
FIG. 12B is a cross-section view of the adaptor of FIG. 2 coupled with a vial when a user withdraws a dose from the vial.
Figure 13A:
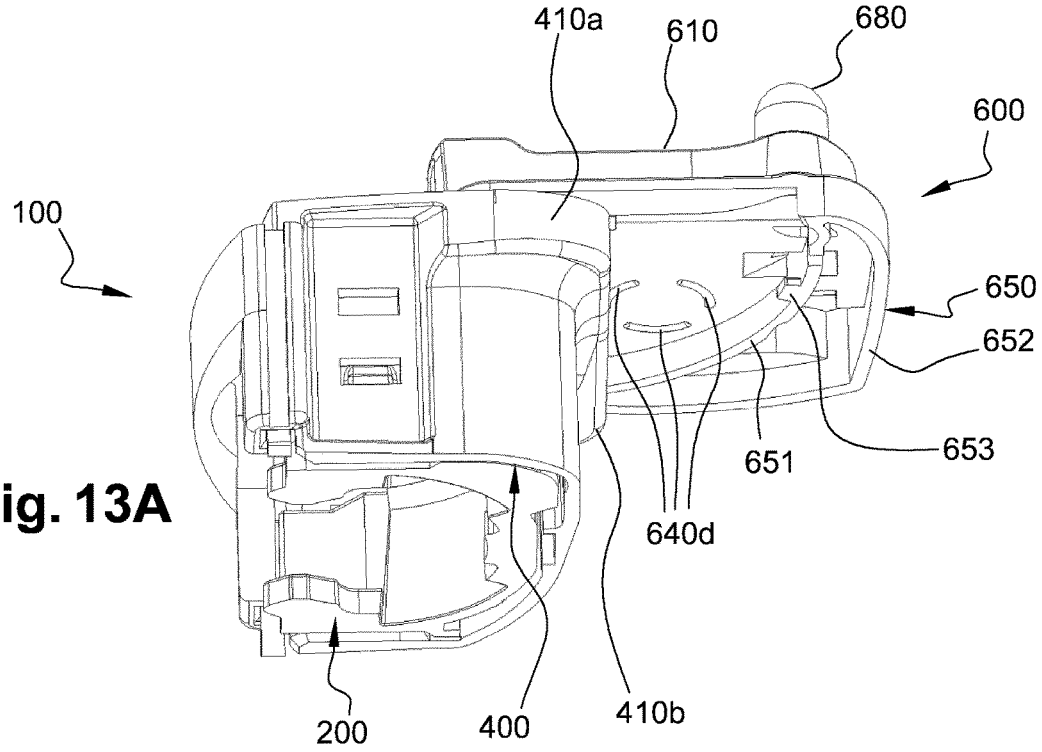
FIGS. 13A and 13B are respectively a perspective view from the bottom and a perspective view from the top of another embodiment of the closing system of the present invention.
Figure 13B:
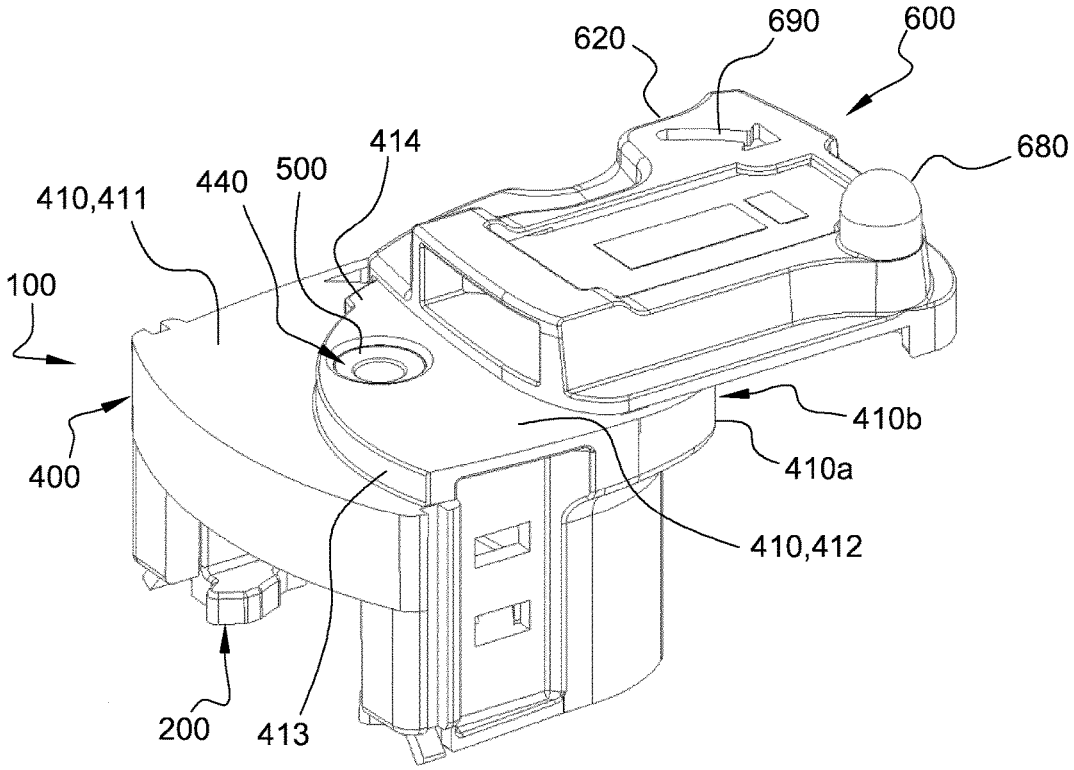

With reference to FIGS. 13A and 13B is shown an adaptor 100 in accordance with another embodiment of the present invention. Similarly to the adaptor 10 of FIGS. 2 to 12C, the adaptor 100 comprises a gripping member 200, a cap 400, a pierceable elastomeric piece 500 and a cover 600. As previously mentioned, the gripping member and the pierceable elastomeric piece are optional elements of the closing system of the invention and may be omitted.

The cap 400 comprises a transversal wall 410 having a substantially four-sided shape and divided into a low front portion forming a distal lodging 411 separated from a high rear proximal portion 412 by a curved step 413 (see FIG. 13B), the reason of which being explained later. The high rear proximal portion 412 is provided with a rear corner 410*a*, a rear extension 410*b* and an access port 440 accommodating the pierceable elastomeric piece 500. The curved step 413 can be provided with a longitudinal shoulder 414.

The cover 600 comprises a sheet 610 having substantially the shape of the transversal wall 410 of the cap 400 and being substantially parallel to the transversal wall 410. Similarly to the cover 60 of the adaptor 10 shown in FIGS. 2 to 12C, the proximal face of the sheet 610 is provided with a pushing surface 620 and a guiding member, in the form of a stud 680 in FIGS. 13A and 13B, and a proximal arrow 690. On FIG. 13A, the distal face of the cover 610 is provided with a discontinuous circular rim 640*d* comprising three segments and intended to face the access port 440 of the cap 400 when the cover 600 is in its first, closed position. The distal face of the sheet 610 is further provided with a protruding ridge 650 consisting in a curved segment 651 and in a cornered segment 652, and located offset from the circular rim 640*d*. The protruding ridge 650 therefore defines a distal extension of the cover 600, located offset from the part of the cover intended to face the access port in the first closed position of the cover. The distal extension formed by the protruding ridge 650 is shaped and dimensioned so that it is capable of being received into the distal lodging 411 of the transversal wall 410 of the cap 400. The protruding ridge 650 can be provided with a transversal peg 653 intended to cooperate with the longitudinal shoulder 414 of the step 413 to maintain the cover 600 in a closed position.

When the user grabs the adaptor 100, one of his fingers is in contact with the rear extension 410*b*, similarly to what is shown on FIGS. 12A and 12B and the user is therefore preserved from picking or accidentally contacting the elastomeric piece 500 during operation of the adaptor 100. Furthermore, in this embodiment, when the user moves the cover 600 from its closed position to its open position (shown in FIGS. 13A and 13B) and back to its closed position, any contact between his hand and the discontinuous circular rim 640*d* is therefore avoided by the protruding ridge 650.

In the case of inappropriate operation of the adaptor 100, for example with unclean hands, contaminants are thus restricted to the rear extension 410*b* and the protruding ridge 650. When the user moves the cover 600 back from its open position to its closed position, the protruding ridge 650 only faces the low front portion forming the distal lodging 411 of the cap 400 and the curved segment 651 contacts the curved step 413. The distal extension of the cover 600, formed by the protruding ridge 650, is therefore received in the distal lodging 411 and is separated by the curved step 413 from the proximal portion 412 of the transversal wall 410 where the access port 440 is located. Contaminants potentially present on the distal extension are therefore restricted to the distal lodging 411 of the transversal wall 410 while the needle access port 440 accommodating the elastomeric piece 500 is covered by the clean circular rim 640*d*.

The protruding ridge 650 therefore forms part of the protection means, when the cover 600 is in its second or open position, for preventing contact between the user's hand and the part of the cover 600, for example the circular rim 640*d*, intended to face the access port 440 in the first or closed position of the cover The low front portion forming the distal lodging 411, the high rear proximal portion 412 and the curved step 413 of the transversal wall 410, together with the rear extension 410*b* therefore help preventing any contamination to be transferred from the user's hand to the access port 440 and the pierceable elastomeric piece 500 through the cover 600. When the adaptor 100 is mounted on a vial storing a pharmaceutical product, these features consequently prevent contaminants to reach the inside of the vial and to damage the efficacy and the sterility of the stored pharmaceutical product.

The invention claimed is:

1. A closing system for a container, the closing system comprising:

a cap comprising a skirt and a transversal wall provided with an access port;

a cover parallel to the cap, the cover comprising a proximal face having a protrusion extending therefrom and a proximally curved pushing surface extending from the proximal face, said proximally curved pushing surface and said protrusion each extending from the proximal face, but offset from one another; and a hinge allowing a planar rotation of the cover regarding the cap from a first position closing the access port to a second position giving access to the access port, wherein the cover further comprises a front portion, a rear portion, a first side, and a second side, the rear portion located opposite the front portion, and the first side located opposite the second side, wherein the pushing surface and the protrusion are located on the first side of the cover and, wherein the pushing surface and the protrusion are positioned with respect to each other such that the protrusion is located closer to the hinge than the pushing surface to facilitate rotation of the cover with respect to the cap.

2. The closing system according to claim 1, wherein the hinge comprises a shaft extending in a distal direction from the cover, and a corner hole provided in the transversal wall.

3. The closing system according to claim 1, wherein the protrusion is a stud.

4. The closing system according to claim 1, wherein the hinge is located on the second side of the cover.

5. The closing system according to claim 1, wherein the hinge is located on the rear portion of the cover.

6. The closing system according to claim 1, wherein the pushing surface is located on the front portion of the cover and the protrusion is located on the rear portion of the cover.

7. The closing system according to claim 3, wherein the stud and the hinge are located on the rear portion of the cover.

8. The closing system according to claim 3, wherein the hinge is located on the second side of the cover.

9. A closing system for a container, the closing system comprising:

a cap comprising a skirt and a transversal wall provided with an access port;

a cover parallel to the cap, the cover comprising a proximal face, a distal face, and a protrusion extending from the proximal face and a proximally curved pushing surface extending from the proximal face for manipulating the cover; and a hinge allowing a planar rotation of the cover regarding the cap from a first position closing the access port to a second position giving access to the access port, the closing system further comprising an engagement member comprising a tooth located on a flexible leg parallel to the cover, and three openings located on the transversal wall, the engagement member allowing only a clockwise or a counterclockwise rotation.

10. The closing system according to claim 1, further comprising a lock to maintain the cover in a closed position.

11. The closing system according to claim 10, wherein the lock comprises a peg located on a longitudinal extension of the cover, and a notch located on the skirt.

12. The closing system according to claim 1, wherein the transversal wall comprises a rear extension configured to block a finger of the user when the user grasps the closing system.

13. The closing system according to claim 1, further comprising a protection member including a protruding ridge for preventing contact, when the cover is in its second position, between the user and a part of the cover facing the access port in the first position of the cover.

14. The closing system according to claim 13, wherein the protruding ridge is located on a distal face of the cover, offset from the part of the cover facing the access port in the first position of the cover, wherein the protruding ridge defines a distal extension of the cover.

15. The closing system according to claim 14, wherein the protection member further includes a step on the transversal wall of the cap, the step separating the transversal wall into a proximal portion where the access port is located, and a distal lodging, offset from the access port, wherein the distal lodging is shaped to receive the distal extension of the cover when the cover is in its first position.

16. The closing system according to claim 1, wherein the protrusion and the pushing surface are offset from the hinge.

17. The closing system according to claim 1, wherein the protrusion, the pushing surface, and the hinge are located along a perimeter of the cover and the protrusion is located between the pushing surface and the hinge.

18. The closing system according to claim 1, wherein the cap includes a front rim and wherein the cover is mounted to the cap such that the front portion of the cover is aligned with the front rim of the cap.

19. The closing system according to claim 1, wherein the pushing surface and the protrusion are positioned with respect to each other to facilitate one-handed 360° rotation of the cover with respect to the cap.

* * * * *